US005232114A

United States Patent [19]

Zysset

[11] Patent Number: 5,232,114

[45] Date of Patent: Aug. 3, 1993

[54] FULL-OPEN CONVENIENCE CLOSURE

[75] Inventor: Edgar H. Zysset, St. Cloud, Fla.

[73] Assignee: Crown Cork & Seal Company, Inc., Philadelphia, Pa.

[21] Appl. No.: 927,829

[22] Filed: Aug. 10, 1992

[51] Int. Cl.[5] ..... B65D 17/34; B65D 17/40

[52] U.S. Cl. ..... 220/273; 220/276; 220/270

[58] Field of Search ..... 220/276, 269, 266, 270, 220/273

[56] References Cited

U.S. PATENT DOCUMENTS

| | | | |
|---|---|---|---|
| 3,544,025 | 12/1970 | La Croce et al. | 220/54 |
| 3,606,076 | 9/1971 | Hanke et al. | 220/273 |
| 3,724,709 | 4/1973 | Westphal | 220/273 |
| 3,735,892 | 5/1973 | Kinkel | 220/273 |
| 3,752,353 | 8/1973 | Slade | 220/273 |
| 3,784,048 | 1/1974 | McKernan | 220/270 |
| 3,951,299 | 4/1976 | Khoury | 220/273 |
| 4,002,262 | 1/1977 | Khoury | 220/271 |
| 4,044,915 | 8/1977 | LaCroce et al. | 220/270 |
| 4,182,460 | 1/1980 | Holk, Jr. et al. | 220/271 |
| 4,848,623 | 7/1989 | Saunders et al. | 220/273 |
| 5,038,956 | 8/1991 | Saunders | 220/271 |
| 5,052,573 | 10/1991 | Zysset | 220/271 |

*Primary Examiner*—Stephen P. Garbe
*Assistant Examiner*—Vanessa Caretto
*Attorney, Agent, or Firm*—Woodcock Washburn Kurtz Mackiewicz & Norris

[57] ABSTRACT

An improved full-open type of convenience closure includes an end panel having a peripheral score defined therein to define fixed and removable end panel portions, a tab having a nose portion for exerting a downward force on the end panel adjacent the peripheral score, a rivet formation for securing the tab to the end panel, and a moustache score for, among other purposes, providing a pivot point for the tab. The rivet formation includes a raised area on the end panel which is defined by an outer edge. The moustache score is curved away from the peripheral score at the point where it intersects the outer edge, thereby preventing tearing along the outer edge during opening.

7 Claims, 3 Drawing Sheets

FULL-OPEN CONVENIENCE CLOSURE

BACKGROUND OF THE INVENTION

1. Field of the Invention

This invention relates broadly to the field of convenience closures for full-open type can ends. More specifically, this invention relates to an improved rivet formation for attaching a gripping tab to an end panel of such a can end.

2. Description of the Prior Art

One form of self-opening can which is in wide use is the so called full-open can, in which a peripheral score, generally circular in configuration, is formed in the end panel at or adjacent to the periphery thereof to permit its complete removal. Full-open type cans are to be distinguished from those self opening cans which have a comparatively small removable section which, when opened, provide a comparatively small hole for dispensing the product. The latter type of can end is only appropriate for packaging soda, beer, or other liquids. Full-open type cans, on the other hand, are suitable for packaging solid products such as candy, nuts, meats, or ground coffee.

A conventional full-open type can end is depicted in FIGS. 1-3. Can end 10 conventionally includes an end panel 12 and an edge-curled peripheral flange 14 Which is adapted to be inter folded with an end flange of a can body. At or adjacent to the periphery of end panel 12 is a peripheral score 16 which is indented into the end panel 12 and defines a fixed can end portion 18 and a removable portion or panel 20. A gripping tab 22 is mounted to the end panel 12 by means of a rivet formation 24. The gripping tab 22 is positioned close enough to the peripheral score 16 so that when its inner end is rocked upwardly to cause its outer end to move downwardly and exert a downward force on the end panel 12 at or near the peripheral score 16, a portion of the end panel 12 is bent downwardly to initiate rupture of the peripheral score 16. Thereafter, an upward and backward pull on the gripping tab 22 by the user induces tearing of the metal in the peripheral score 16 on both sides of the area of initial rupture to complete detachment from the can of the removable portion or panel 20 of the end panel 12.

Typically, rivet formation 24 is formed out of the material of end panel 12 by die pressing or a similar process. Specifically, the rivet formation 24 includes a raised area 26 defined by an outer edge 28. Referring briefly to FIGS. 2 and 3, raised area 26 includes what is commonly termed a first operation bubble 30. First operating bubble 30 is ordinarily formed by a first die pressing operation in the end panel 12. Raised area 26 further includes a second operation bubble 32, which is formed in a second die press step which is performed on the first operation bubble 30, as may be seen in FIG. 3. The first and second operation bubbles 30, 32 are formed as concentric circles in the end panel 12. The second operation bubble 32 is subsequently formed into the flattened rivet head which secures the gripping tab 22 to the end panel 12.

To promote flexibility and to provide a hinge point for the tab 22 when it is lifted, a mustache score 34 is typically formed in the end panel 12, as is illustrated in FIG. 1. Mustache score 34 typically has an inner portion 36 defined on the raised area 26 of rivet formation 24, and at least one outer portion 38 defined on the outer surface of end panel 12. The inner portion 36 of mustache score 34 may be defined on the first operation bubble 30, and be curved about the radial inner periphery of the second operation bubble 32. The outer portions 38 of the mustache score 34 would typically be shaped so as to flare outwardly from the respective inner portions 36, and would typically end up substantially parallel to the peripheral score 16 at the outer most extent thereof.

Unfortunately, tearing would sometimes occur along the inner portion 36 of the mustache score 34 during opening. It is thought that such tearing initiates in the area of inner portion 36 which is adjacent to the second operation bubble 32, and that the tearing propagates along the mustache score 34 to the point where the mustache score 34 intersects with the outer edge 28 of the raised area 26 in rivet formation 24. The tearing would then continue to propagate radially outwardly along the outer edge 28 of the raised area 26, sometimes resulting in the failure of the can end 10 to open.

It is clear that there has existed a long and unfilled need in the prior art for an improved full-open type can end which is less susceptable to failure due to unwanted tearing during opening of.

SUMMARY OF THE INVENTION

Accordingly, it is an object of the invention to provide an improved full-open type can end which is less likely to fail during opening as a result of tearing than prior art full-open type can end designs were.

It is a further object of the invention to provide an improved full open type can end which provides a stronger can end wall than was possible in can end designs heretofore known.

In order to achieve the above and other objects of the invention, a full open type convenience closure which is adapted for sealing an end of a can according to a first aspect of the invention includes an end panel; a peripheral score defined in the end panel, the peripheral score defining fixed and removable portions of the end panel; a tab having a nose portion for exerting a downward force on the end panel adjacent the peripheral score; a rivet formation for securing the tab to the end panel, the rivet formation including a raised area on the end panel, the raised area having an outer edge; and a mustache score defined in the end panel and partially within the raised area for providing a pivot point for the tab, the mustache score being curved away from the peripheral score at the point where it intersects the outer edge, whereby tearing along the outer edge is prevented during opening.

According to a second aspect of the invention, a full open type of convenience closure which is adapted for sealing an end of a can includes an end panel; a peripheral score defined in the end panel, the peripheral score defining fixed an moveable portions of the end panel; a tab having a nose portion for exerting a downward force on the end panel adjacent the peripheral score; a rivet formation for securing the tab to the end panel, the rivet formation including an oval-shaped raised area on the end panel, the raised area having an outer edge; and a moustache score defined in the end panel and partially within said oval-shaped raised area for providing a pivot point for the tab.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 4:
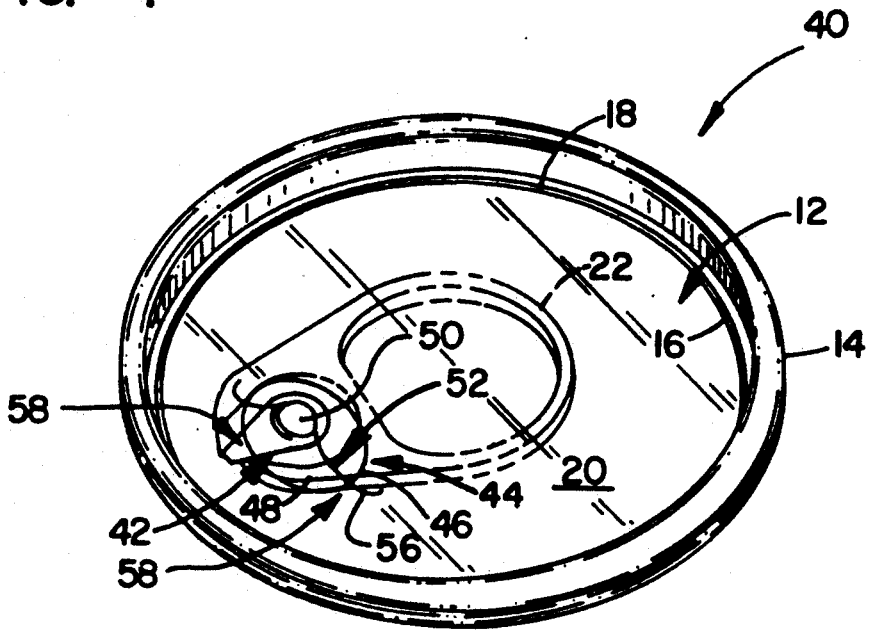
FIG. 4 is a perspective view of a can assembly constructed according to a preferred embodiment of the invention.
Figure 5:
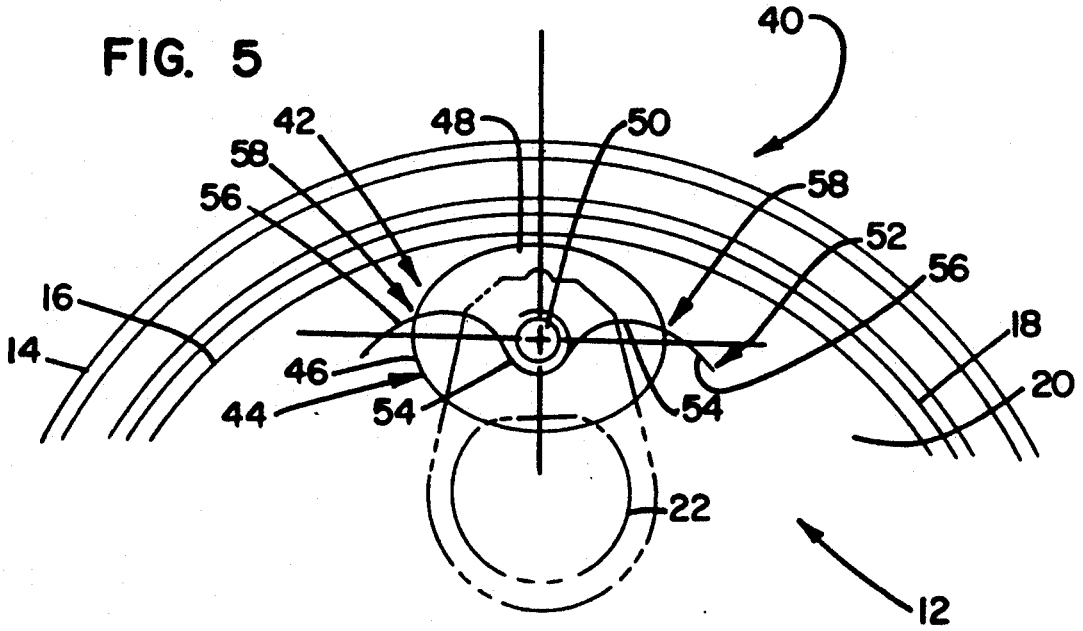
FIG. 5 is a top plan fragmentary view of a can end according to the embodiment of FIG. 4, with portions broken away for clarity.
Figure 6:
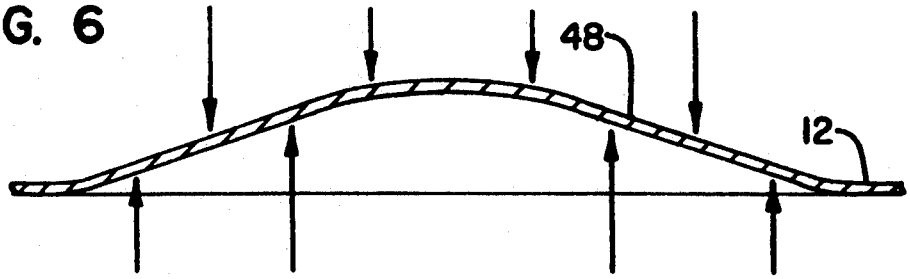
FIG. 6 is a diagrammatical view depicting formation of an element in the embodiment of FIGS. 4 and 5.
Figure 7:
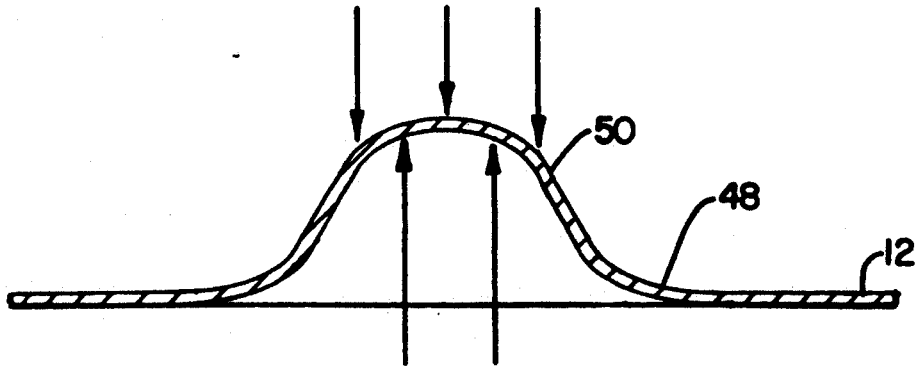
FIG. 7 is a diagrammatical view depicting formation of a second element in the embodiment of FIGS. 4–6.

Referring now to the drawings, wherein like reference numerals designate corresponding structure throughout the views, and referring in particular to FIGS. 4 and 5, a can end 40 according to a preferred embodiment of the invention includes an improved rivet formation 42 having a raised area 44 which is defined by an outer edge 46. Raised area 44 includes an oval shaped first operation bubble 48, which is elongated along an axis which is a chord perpendicular to a radius of end panel 12. Raised area 44 further includes a second operation bubble 50, which is defined centrally with respect to the first operation bubble 48. The formation of the first operation bubble 48 and the second operation bubble 50, are diagrammatically shown in FIGS. 6 and 7, respectively.

Figure 1:
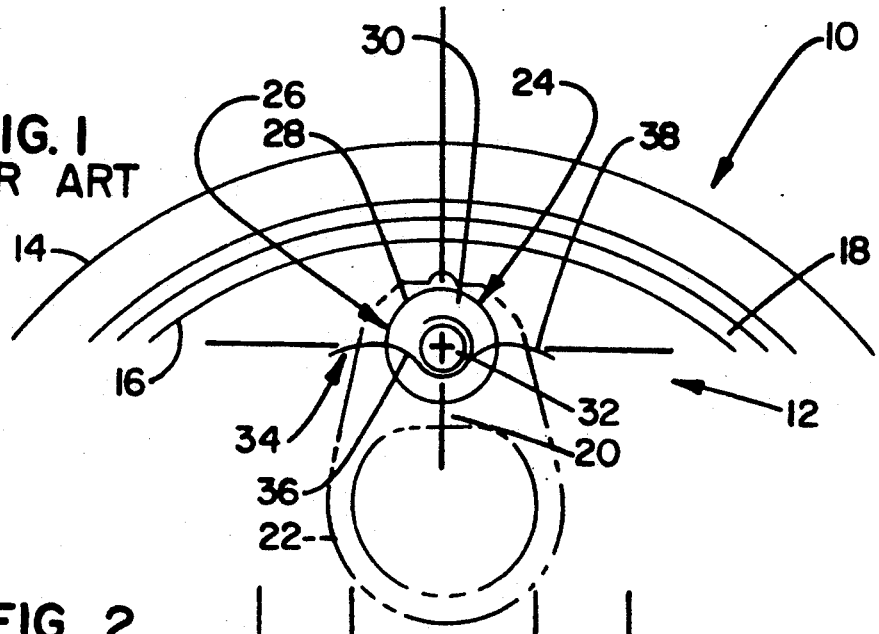
FIG. 1 PRIOR ART
FIG. 1 is a fragmentary top plan view of a prior art can end, with portions broken away for clarity.
Figure 2:
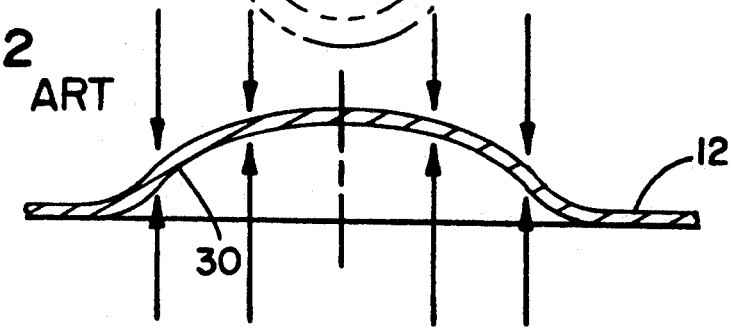
FIG. 2 PRIOR ART
FIG. 2 is a diagrammatical view depicting formation of a first element in the prior art design depicted in FIG. 1.
Figure 3:
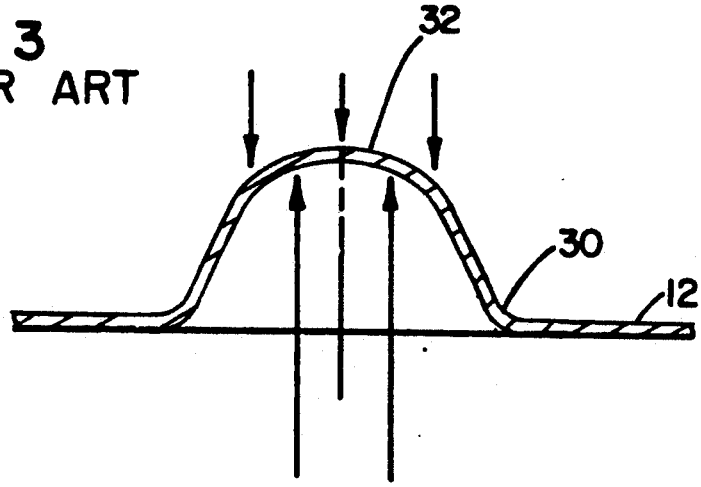
FIG. 3 PRIOR ART
FIG. 3 is a diagrammatical view depicting a second operation used in forming the prior art design depicted in FIGS. 1 and 2.

Can end 40 further includes a mustache score 52, which is larger than the mustache score 34 depicted in prior art FIG. 1. Mustache score 52 includes an inner portion 54 and a pair of outer portions 56.

According to one important aspect of the invention, mustache score 52 is curved away from the peripheral score 16 in the end panel 12 at the point 58 where mustache score 52 intersects the outer edge 46 of the raised area 44 in rivet formation 42. If, during opening of the can end 40, tearing originates adjacent to the second operation bubble 50 in the inner portion 54 of mustache score 52, such tearing may propagate along the inner portions 54 of mustache score 52, but such tearing will be prevented from continuing to propagate radially outwardly along the outer edge 46 of the raised area 44, due to the curvature of the mustache score 52. The tear, propagating along the inner portion 54 in the outward direction, has been found not likely to double back at the point 58 where score 52 intersects outer edge 46 to the extent it would need to follow the outer edge 46 toward the peripheral score 16.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A full-open type of convenience closure which is adapted for sealing an end of a can, comprising:
   an end panel;
   a peripheral score defined in said end panel, said peripheral score defining fixed and removable portions of said end panel;
   a tab having a nose portion for exerting a downward force on said end panel adjacent said peripheral score;
   a rivet formation for securing said tab to said end panel, said rivet formation including a raised area on said end panel, said raised area having an outer edge; and
   a moustache score defined in said end panel and partially within said raised area for providing a pivot point for said tab, said moustache score intersecting said outer edge of said raised area and being curved away from said peripheral score at the it intersects said outer edge, whereby tearing along said outer edge is prevented during opening.

2. A closure according to claim 1, wherein said raised area is non-circular in shape.

3. A closure according to claim 2, wherein said raised area is oval-shaped.

4. A can for goods, comprising:
   a can body having an open end; and
   a convenience closure fitted on said open end, said convenience closure comprising:
   an end panel;
   a peripheral score defined in said end panel, said peripheral score defining fixed and removable portions of said end panel;
   a tab having a nose portion for exerting a downward force on said end panel adjacent said peripheral score;
   a rivet formation for securing said tab to said end panel, said rivet formation including a raised area on said end panel, said raised area having an outer edge; and
   a moustache score defined in said end panel and partially within said raised area for providing a pivot point for said tab, said moustache score intersecting said outer edge of said raised area and being curved away from said peripheral score at the point where it intersects said outer edge, whereby tearing along said outer edge is prevented during opening.

5. A can according to claim 4, wherein said raised area is non-circular in shape.

6. A closure according to claim 5, wherein said raised area is oval-shaped.

7. A full-open type of convenience closure which is adapted for sealing an end of a can, comprising:
   an end panel;
   a peripheral score defined in said end panel, said peripheral score defining fixed and removable portions of said end panel;
   a tab having a nose portion for exerting a downward force on said end panel adjacent said peripheral score;
   a rivet formation for securing said tab to said end panel, said rivet formation including an oval-shaped raised area on said end panel, said raised area having an outer edge; and
   a moustache score defined in said end panel and partially within said oval-shaped raised area for providing a pivot point for said tab.

* * * * *